United States Patent [19]

Guibert

[11] 4,051,893

[45] Oct. 4, 1977

[54] AIR CURTAIN-PROJECTING VENTILATOR

[76] Inventor: Raul Guibert, 8343 W. 4th St., Los Angeles, Calif. 90048

[21] Appl. No.: 714,832

[22] Filed: Aug. 16, 1976

[30] Foreign Application Priority Data

Aug. 18, 1975 Argentina ..... 259758
Aug. 18, 1975 Argentina ..... 259759

[51] Int. Cl.[2] ..... F28F 13/12; F24F 9/00

[52] U.S. Cl. ..... 165/125; 165/122; 98/36; 418/259

[58] Field of Search ..... 98/36; 55/DIG. 18, DIG. 29; 165/125, 122; 418/259–262, 266, 268

[56] References Cited

U.S. PATENT DOCUMENTS

| | | | |
|---|---|---|---|
| 2,673,074 | 3/1954 | Dailey | 165/125 |
| 3,322,932 | 5/1967 | Laing | 165/122 |
| 3,350,994 | 11/1967 | Guibert | 98/36 |
| 3,612,173 | 10/1971 | Goyal | 165/122 |
| 3,702,918 | 11/1972 | Moller | 165/122 |

*Primary Examiner*—William F. O'Dea
*Assistant Examiner*—Henry C. Yuen

[57] ABSTRACT

A ventilator adapted to project a uniform air curtain of high velocity and of high pressure. The ventilator is in the form of an elongated air pump in which a rotor shaft is mounted eccentrically within an open coil helix lining the tubular casing of a stator assembly having parallel intake and outlet slots extending the full length of the casing. The shaft is provided with centrifugal vanes which are caused by centrifugal force to engage the convolution of the helix and to slide therealong, whereby the helix functions to engage the vanes without interfering with the flow of air into the pump and its ejection through the outlet.

11 Claims, 10 Drawing Figures

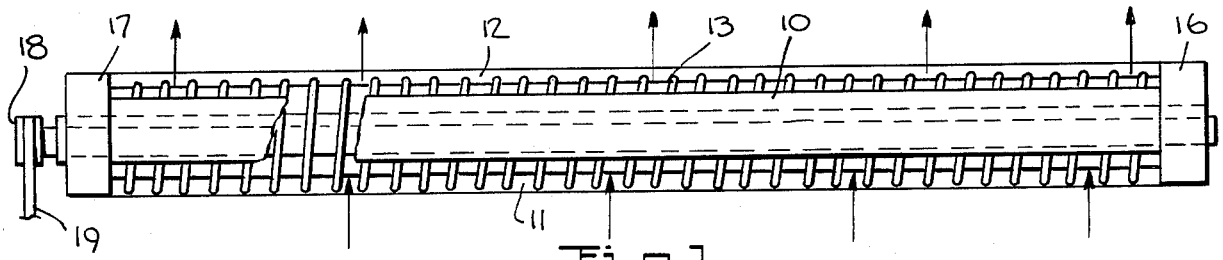
Fig. 1.
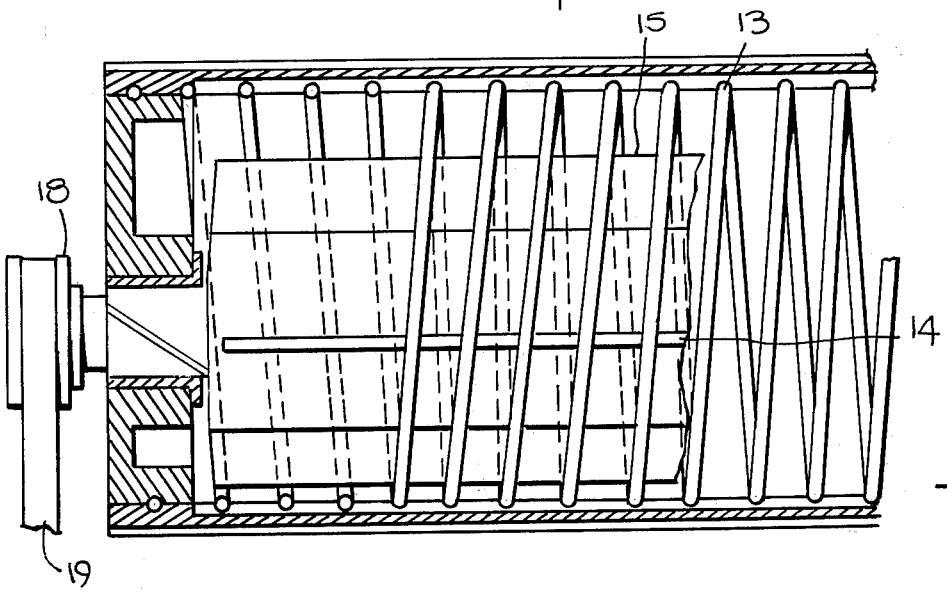
Fig. 5.
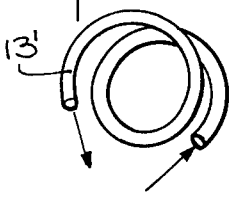
Fig. 2.
Fig. 6.
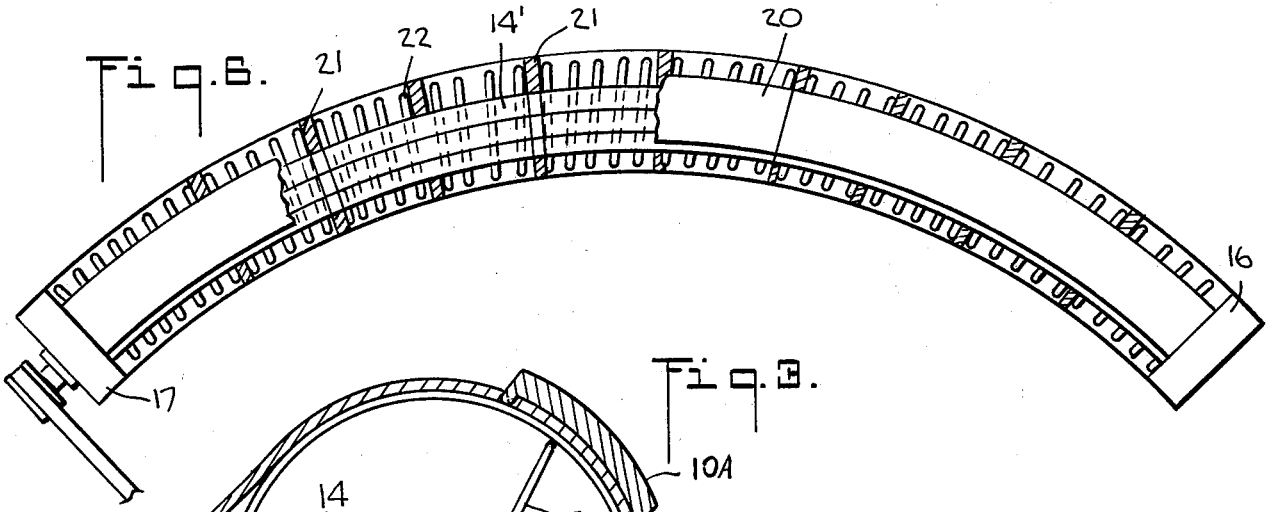
Fig. 3.
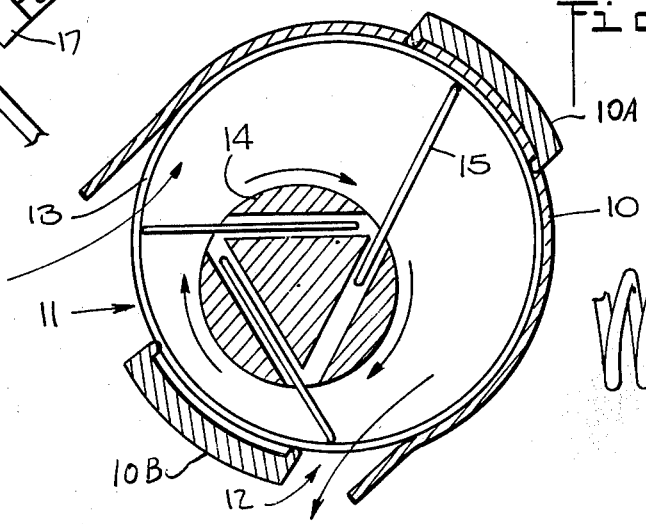
Fig. 4.
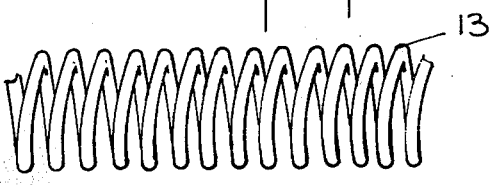

Fig. 7.
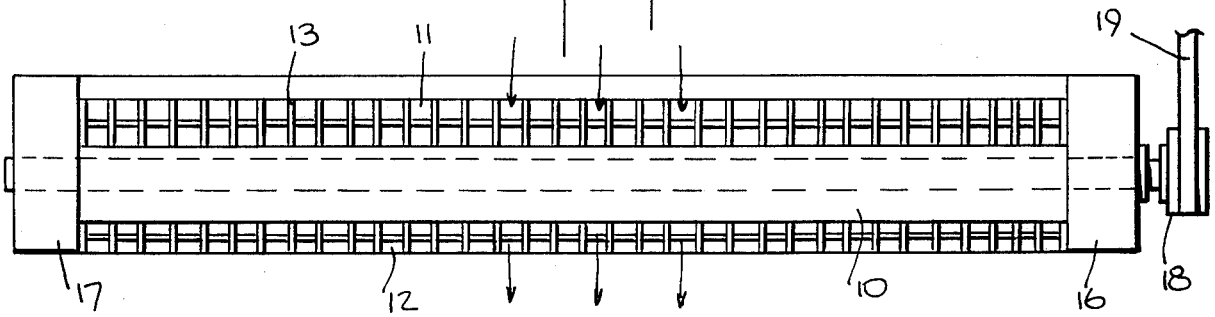
Fig. 8.
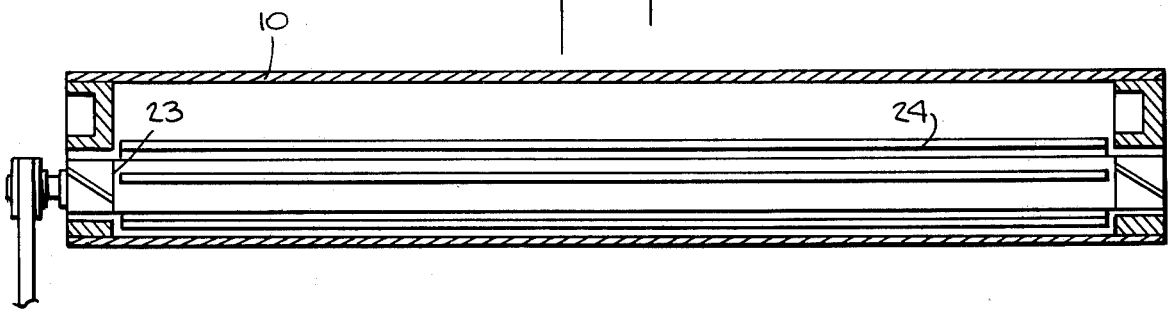
Fig. 10.
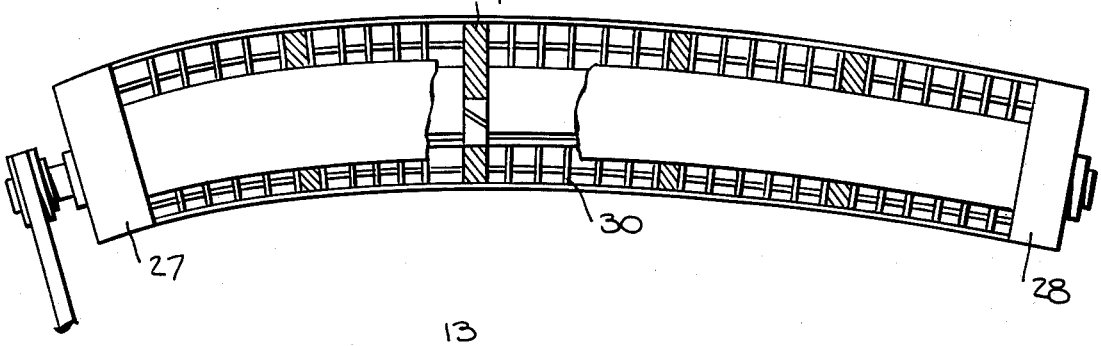
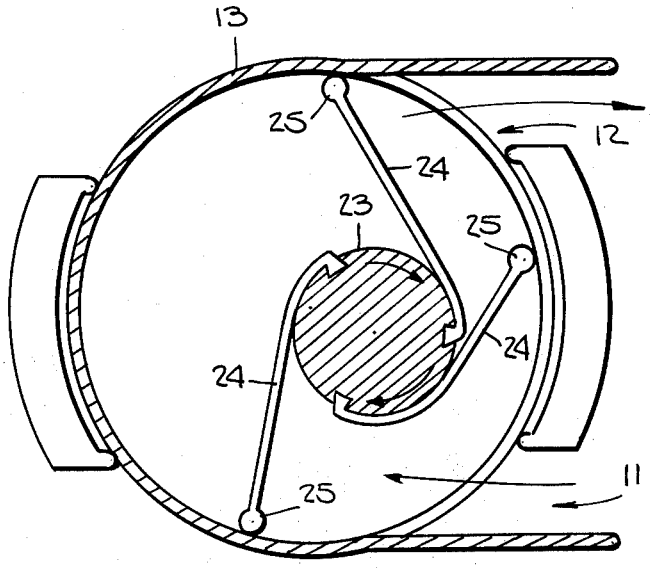
Fig. 9.

AIR CURTAIN-PROJECTING VENTILATOR

BACKGROUND OF INVENTION

This invention relates generally to an air curtain-projecting ventilator, and more particularly to a ventilator whose rotor is provided with centrifugal vanes operating within the confines of an open-coil helix lining the tubular casing of a stator assembly having longitudinally extending intake and outlet slots to generate a uniform air curtain of high velocity.

In my prior U.S. Pat. No. 3,350,994 isued Nov. 7, 1967, there is disclosed a ventilating system which projects and air curtain by means of a tubular casing having a rotor mounted eccentrically therein, the rotor extending the full length of the casing and being provided with outstretched vanes or wings whose free edges are tracked to run adjacent to the inner surface of the casing. The casing is formed with a large intake opening and a narrow outlet parallel thereto, so that as air passes through the intake, it is collected by the vanes, compressed thereby and forced out through the outlet at great velocity.

This ventilator functions as an efficient centrifugal air pump to produce an air curtain which is fully effective throughout the entire length of the outlet. On the intake or suction side of the air pump, one may install heating, cooling, and air filter elements to condition the air.

Such air curtain-projecting ventilators have many practical applications and are useful wherever it is necessary to thermally or otherwise isolate a given region, such as the interior of a building from the exterior, without interposing a physical barrier in the entrance thereto. For example, where a working station is to be maintained in a clean atmosphere, one may use an air curtain to isolate this station from a surrounding contaminated atmosphere.

The difficulty experienced with a ventilating air pump structure of the type disclosed in my prior patent is that the intake and outlet slots formed in the casing constitute structural gaps in the support for the centrifugal blades of the rotor. Because of these gaps, it becomes necessary to track the vanes at their opposing ends to maintain the free edges of the vanes slightly spaced from the surface of the casing. However, because the vanes are subjected to centrifugal force and are retained only at their ends, they tend to bow and thereby strike the surface of the casing. The resultant knocking action of the vanes produces objectionable noise and degrades the efficiency of the system.

Another factor which has to a degree militated against the success of an air-curtain projecting air pump of the type disclosed in my prior patent is that the centrifugal blades, because of the bowing effect previously mentioned, make contact along their edges with the curved inner surface of the casing, thereby giving rise to a relatively high degree of friction and loss of operating efficiency.

SUMMARY OF INVENTION

In view of the foregoing, it is the main object of this invention to provide an improved ventilator for projecting a uniform air curtain of high velocity.

More particularly, it is an object of this invention to provide a ventilator of the above type which is constituted by an air pump whose rotor shaft is provided with centrifugal vanes operating within the confines of an open-coil helix which lines the tubular casing of a stator assembly having longitudinally-extending intake and outlet slots whereby air drawn into the intake slot is collected, compressed and ejected at high velocity through the outlet slot.

Among the significant features of an air pump in accordance with the invention are that the pump operates with high efficiency in a virtually noiseless fashion and that friction is minimized, so that the power requirements are relatively low. The air curtain projected from the air pump is substantially laminar throughout its entire length, and the structure of the pump is such that it may be readily installed either horizontally or vertically, no ducts being required. Moreover, the air pump requires little maintenance and may be manufactured at low cost.

Briefly stated, these objects are attained in an elongated air pump in which a rotor shaft is mounted eccentrically within an open-coil helix that lines the tubular casing of a stator assembly having parallel intake and outlet slots extending the full length of the casing, the shaft being driven at high speed.

The shaft is provided with centrifugal vanes or wings which are initially retracted and in the course of shaft rotation are caused to extend outwardly to engage the convolutions of the helix and to slide therealong, whereby the helix functions to encage the vanes within the casing without interfering with the incoming flow of air and its ejection from the pump through the outlet slot.

OUTLINE OF DRAWINGS

For a better understanding of the invention as well as other objects and further features thereof, reference is made to the following detailed description to be read in conjunction with the accompanying drawings wherein:

FIG. 1 is a side view of one preferred embodiment of an air curtain-projecting ventilator in accordance with the invention;

FIG. 2 is a longitudinal section taken through a portion of the ventilator;

FIG. 3 is a transverse section taken through the ventilator;

FIG. 4 is a separate view of the helix which is included in the stator assembly;

FIG. 5 is an alternative form of helix formed by a hollow pipe;

FIG. 6 is a side view of a modification of the first embodiment of the ventilator;

FIG. 7 is a side view of a second preferred embodiment of an air curtain-projecting ventilator in accordance with the invention;

FIG. 8 is a longitudinal section taken through the second ventilator, with the helical liner omitted;

FIG. 9 is a transverse section taken through the second ventilator; and

FIG. 10 is a side view of a modification of the second embodiment.

DESCRIPTION OF INVENTION

First Embodiment

Referring now to FIGS. 1 to 4, there is shown a preferred embodiment of an air curtain-projecting ventilator in accordance with the invention. The ventilator is in the form of an elongated air pump that includes a stator assembly constituted by a straight-line tubular casing 10 having a relatively large intake slot 11 and a narrower outlet slot 12 in parallel relation thereto, both slots extending longitudinally along the full length of the casing.

Lining the casing 10 is an open-coil helix 13 which is fabricated of polished steel wire or other material having a low coefficient of friction, such as Teflon. The convolutions of helix 13 are well separated from each other, the helix defining a cage within the casing which creates grids bridging the intake and outlet slots.

Mounted eccentrically within the stator assembly adjacent the intake and outlet slots is a rotor shaft 14 supporting a set of three centrifugal vanes or blades 15. The blades are freely slidable in slots formed in the rotor, the slots being cut in the pattern of an equilateral triangle so that in their retracted positions the blades fully occupy the slot with their inner edges touching the adjacent blade to limit further retraction thereof. Rotor shaft 14 is supported at either end of the casing by bearings 16 and 17. One end of the rotor shaft terminated in a pulley 18 having a motor-driven endless belt 19 looped thereover to rotate the rotor shaft at high speed. As a consequence, blades 15 are caused by centrifugal force to slide outwardly and press against the convolutions of helix 13.

When blades 15 are outwardly extended by centrifugal force to engage the convolutions of the helix, they serve to effectively divide the stator assembly into three air compartments whose volumes are unequal and vary with the angular position of the rotor shaft. Because the edges of the blades make contact not with the inner surface of casing 10, but with the convolutions of the helix, sliding contact is effected along a series of distinct points rather than along a broad area, thereby minimizing friction.

Since these convolutions extend across the gaps in the casing created by the intake and outlet slots, the gaps are bridged by grids which in no way interfere with the flow of air into and out of the air pump and yet maintain continuity in the circular path traversed by the rotating blades. Thus there are no irregularities encountered by the blades in the course of shaft rotation, and the system operates at a relatively low noise level, as compared to prior art structures.

As best seen in FIG. 3, air entering the relatively broad inlet 11 is collected by the centrifugal blades 15 and is compressed in the compartments defined thereby, the air being ejected at high velocity through the narrower outlet 12 to project a uniform air curtain therefrom. the slots are provided with flanges which are angled to direct the air flow.

In helix 13 shown in FIG. 4, the coil is formed of solid wire, whereas in the alternative form shown in FIG. 5, coil 13' is formed of tubular piping material. Hence the helix may be used to convey a refrigerant or a heated fluid in heat exhange relationship with the air in the air pump, thereby obviating the need for heating or cooling elements in advance of the intake, as in prior art structures. Alternatively, the helix may be used to conduct a lubricant through the casing which serves to coat the surface engaged by the blades through minute apertures in the tubing. Alternatively, the tube may made of oil-permeable material. Also, while three blades have been shown, in practice any suitable number thereof may be used.

Since the convolutions of helix 13 are physically in contact with the inner surface of casing 10, there is no leakage path in the air pump despite the separation of the blade edges from the surface of the casing. The casing may be reinforced by oppositely-disposed strips 10A and 10B, as shown in FIG. 3.

Modification of First Embodiment

In the air pump illustrated in FIG. 6, the structure has an arcuate formation whereby the resulant air curtain has a converging pattern. In this instance, rotor 14', which is supported at either end by main bearings 16 and 17 within a casing 20, is constituted by a series of articulated segments supported by intermediate bearings 21. The open coil helix 22 which lines the casing has a corresponding curvature.

In all other respects, this curvilinear air pump functions in the same manner as that shown in FIG. 1, air sucked into the intake being projected at high velocity through the outlet slot.

Second Embodiment

In the air pump disclosed in FIGS. 7, 8 and 9, the structure is essentialy the same as that of the first embodiment, the stator assembly being constituted by a casing 10 having a broad intake slot 11 and a parallel narrow outlet slot 12, the casing being lined by an open coil helix 13 to bridge the gaps.

However, in this embodiment, rotor shaft 23 eccentrically mounted within the stator assembly and adjacent the slots is provided with a set of three vanes 24 of flexible, inelastic material, which are anchored on the shaft at equidistant points. In practice, the vanes may be formed of plastic or fabric sheeting. Each vane terminates at its free end in a weighted cord 25 which runs the full length of the vane and engages the convolutions of the helix.

Each vane 24 has a breadth that is greater than the straight line distance between its point of attachment to rotor shaft 23 and the convolutions of helix 13. As a result, when the rotor shaft turns to create a centrifugal force, a reserve portion of each vane is wound on the shaft and the remaining or active portion of the vane is extended outwardly to divide the casing into air compartments. Because the rotor shaft is mounted eccentrically within the helix, the radial distance between the surface of the shaft at any point therein and the helix varies as a function of shaft angle.

In lieu of weighted cords which make sliding contact with the convolutions of the helix, use may be made of a bead of Teflon or other low coefficient material for the same purpose. The weight at the ends of vance 24 is sufficient to produce the centrifugal force which causes the vane ends to engage the helix. Rotor shaft 23 acts as a control pulley, which in the course of its rotation more or less winds a portion of each blade on its surface. It is for this reason that with rotation of the shaft, each vane 24 has its active portion extended to the limit imposed by its weighted cord 25 or bead within helix 13. But since the cord or bead slides along the convolutions of the helix, the resultant resistance causes the active part of the vane to assume a tangential position relative to the rotor shaft.

This tangential projection of the active portion of the vanes occurs throughout the closed circuit rotary cycle in accordance with the distance of the rotary shaft relative to the helix. Thus in the course of each rotary cycle, each vane undergoes an extension to the degree limited by the helix, the relation between the reserve portion of the vane wound on the rotor shaft and the active portion extending tangentially from the shaft varying with angle. As a consequence, the volume of the air compartments defined by the blades varies from a minimum to a maximum value to provide a highly efficient centrifugal air pump.

Modification of Second Embodiment

In the air pump illustrated in FIG. 10, the structure has an arcuate rather than a rectilinear formation, and rotor 26, which is supported at either end by main bearings 27 and 28, is constituted by a series of articulated segments supported by intermediate bearings 29. Open coil helix 30 which lines the casing has a corresponding curvature. The air pump in all other respects functions in the same manner as that in FIGS. 7 to 9 to suck in air through its longitudinally-extending intake and to expel the air through the outlet slot to produce an air curtain of high velocity.

Because an elongated air-curtain projecting ventilator according to the invention acts as a positive displacement pump and in a manner similar to an air compressor, the air curtain projected thereby is not only at a high velocity but also is at high pressure. Hence there are practical applications for this ventilaor for which conventional air curtain-projecting devices are unsuitable. For example, the high-pressure, high-velocity air curtain may be caused to impinge on a water stream to effect aeration thereof. Or the air curtain may be used in a Hovercraft or other air elevated platforms to provide the necessary elevating force. Thus an array of elongated air-curtain projecting ventilators may be mounted on the undersurface of the platform to produce a very powerful air stream for elevating the platform.

While there have been shown and described preferred embodiments of an air curtain-projecting ventilator in accordance with the invention, it will be appreciated that many changes and modifications may be made therein without, however, departing from the essential spirit thereof. For example, while an articulated rotor shaft has been shown for a curvi-linear ventilator, this shaft may be formed of flexible material and bent to the desired curvature.

I claim:

1. An air curtain-projecting ventilator formed by an elongated air pump comprising:

A. a stator assembly formed by a tubular casing having a relatively broad intake slot an a narrower outlet slot in parallel relation thereto, the slots extending longitudinally the full length of the casing, and an open-coil helix lining the casing, the convolutions of the helix bridging the slots to define grids thereacross which in no way interfere with the flow of air through the slots;

B. a rotor shaft mounted eccentrically within the helix and extending the length thereof, said shaft being driven at high speed; and C. a set of extensible vanes supported on said shaft, said vanes when extended by centrifugal force being caused to engage the convolutions of said helix and to slide therealong in an uninterrupted circular path whereby the helix functions to encage the vanes within the casing without interfering with the incoming flow of air through said intake slot and its ejection through said outlet slot to produce a high velocity air curtain.

2. A ventilator as set forth in claim 1, wherein said shaft is supported at either end of said casing by bearings and extends beyond one of said bearings to terminate in a drive pulley.

3. A ventilator as set forth in claim 1, wherein said vanes are constituted by a set of rigid blades which are slidably received in slots formed in the shaft, the free ends of the blades engaging the convolutions of said helix.

4. A ventilator as set forth in claim 3, wherein shaft slots are in the pattern of an equilateral triangle.

5. A ventilator as set forth in claim 1, wherein said helix is formed of solid wire.

6. A ventilator as set forth in claim 5, wherein said wire is stainless steel.

7. A ventilator as set forth in claim 1, wherein said helix is formed of a tubular pipe through which a fluid may be conducted to produce a heat exchanger to heat or cool the air in said casing.

8. A ventilator as set forth in claim 1, wherein said casing, said helix and said shaft have corresponding curvatures to define a curvilinear air pump.

9. A ventilator as set forth in claim 1, wherein said vanes are formed by flexible inelastic sheets which are attached at one end to said shaft, a portion of said vanes being wound on said shaft when the vanes are extended.

10. A ventilator as set forth in claim 9, wherein said vanes terminate in weighted cords.

11. A ventilator as set forth in claim 1, wherein said helix is formed of a tube of permeable material to carry a lubricating fluid.

* * * * *